US006265950B1

(12) United States Patent
Schmidt et al.

(10) Patent No.: US 6,265,950 B1
(45) Date of Patent: Jul. 24, 2001

(54) TRANSITION FROM A WAVEGUIDE TO A STRIP TRANSMISSION LINE

(75) Inventors: Ewald Schmidt, Ludwigsburg; Klaus Voigtländer, Wangen; Hermann Mayer, Vaihingen; Bernhard Lucas, Mundelsheim; Gerd Dennerlein, Nürnberg; Thomas Beez, Weinsberg; Roland Müller, Lichtenau; Herbert Olbrich, Rutesheim; Siegbert Martin, Oppenweiler; Joachim Dutzi, Weissach, all of (DE); John Bird, Nr. Lincoln (GB); David Neil Dawson, Waddington Lincoln (GB); Colin Nash; Brian Prime, both of Lincoln (GB); Cyril Edward Pettit, North Lincolnshire (GB)

(73) Assignees: Robert Bosch GmbH, Stuttgard (DE); Dynex Semiconductor Limited, Lincoln (GB)

( * ) Notice: Subject to any disclaimer, the term of this patent is extended or adjusted under 35 U.S.C. 154(b) by 0 days.

(21) Appl. No.: 09/254,742

(22) PCT Filed: Sep. 6, 1997

(86) PCT No.: PCT/DE97/01979

§ 371 Date: Oct. 15, 1999

§ 102(e) Date: Oct. 15, 1999

(87) PCT Pub. No.: WO98/11621

PCT Pub. Date: Mar. 19, 1998

(30) Foreign Application Priority Data

Sep. 11, 1996 (DE) ..... 196 36 890

(51) Int. Cl.[7] ..... H01P 5/103

(52) U.S. Cl. ..... 333/26; 333/34

(58) Field of Search ..... 333/26, 34

(56) References Cited

U.S. PATENT DOCUMENTS

| | | | | |
|---|---|---|---|---|
| 2,825,876 | * | 3/1958 | Le Vine et al. | 333/26 X |
| 2,979,676 | | 4/1961 | Rueger | 333/34 |
| 4,973,925 | * | 11/1990 | Nusair et al. | 333/26 |

FOREIGN PATENT DOCUMENTS

| | | |
|---|---|---|
| 69 008 | 8/1958 | (FR) . |
| 05 030 807 | 4/1993 | (JP) . |

OTHER PUBLICATIONS

*Williams, "Millimeter–Wave Components and Subsystems built using Microstrip Technology", IEEE Transactions on Microwave Theory and Techniques, vol. 39, No. 5, May 1, 1991, pp. 768–774.

R. K. Hoffman, "Handbook of Microwave Integrated Circuits," Springer–Verlag, 1983, pp. 90–91.

* cited by examiner

*Primary Examiner*—Benny Lee
(74) *Attorney, Agent, or Firm*—Kenyon & Kenyon

(57) ABSTRACT

In order for it to be possible to manufacture a transition with a cost-effective stamping or diecasting or cold-molding process or with a plastic injection-molding process with subsequent metal plating, at least one ridge situated in the waveguide, which reduces the waveguide cross section in the direction of the stripline, has a cross section which tapers conically in the direction of the stripline.

8 Claims, 2 Drawing Sheets

TRANSITION FROM A WAVEGUIDE TO A STRIP TRANSMISSION LINE

FIELD OF THE INVENTION

The present invention relates to a transition from a waveguide to a stripline in which the waveguide has at least one ridge which reduces the waveguide cross section in the direction of the stripline.

BACKGROUND INFORMATION

A conventional transition from a waveguide to a stripline is described in a textbook by Reinmund Hoffmann, Integrierte Mikrowellenschaltung (Integrated Microwave Circuitry), Springer-Verlag 1983, pages 90, 91. As disclosed in this publication, the stepped ridge, which in bonded to the stripline, has a rectangular cross section and is mounted as a separate part in the waveguide. From the aspect of manufacturing technology, this conventional transition from a waveguide to a stripline is relatively costly.

In a transition from a waveguide to a stripline described in Japan Patent No. 05 090807, a ridge having a change in height which is continuous in stages is arranged in the waveguide. The cross-sectional shape of the ridge tapers perpendicularly to the longitudinal axis of the waveguide.

A transition from a waveguide to a stripline is described in French Patent No. 69 008 in which a stepped ridge in the waveguide has a rectangular cross section. This form of the ridge makes manufacturing difficult, particularly if the waveguide is to be one piece with the ridge.

SUMMARY OF THE INVENTION

An object of the present invention is therefore to provide a transition of the above type which can be manufactured at the lowest cost.

The object is achieved in that the cross-section shape of the ridge is tapered perpendicular to the longitudinal axis of the waveguide, specifically from the waveguide wall extending in the direction of the stripline and all steps of the ridge are tapered to the same cross section turned toward the stripline. This conically shaped ridge has the advantage that it can be formed in one piece on a waveguide wall through stamping, or in a diecasting or cold-extrusion process or plastic injection molding process followed by metal plating. The conical shape of the ridge facilitates removal of the manufacturing tool.

In the case of a rectangular cross section of the ridge, there is specifically a danger that it will catch in the tool and that in freeing the tool, the ridge may break off from the waveguide wall. As a result of the conical shape of the ridge, it has a relatively large attachment surface on the wall of the waveguide so that the bond between the waveguide wall and the ridge achieves a high degree of strength. This of course also applies if the ridge is produced as a separate part and is subsequently mounted in the waveguide and is soldered, glued, or screwed to it.

There can be a ridge on the waveguide wall below the stripline as well as on the waveguide wall above the stripline. The height of the ridge or ridges can increase toward the stripline in steps or continuously.

The described structural configuration of the transition facilitates mass production with relatively low cost so that a transition of this kind can be advantageously used in a anticollision radar device for automobiles in order, for example, to be able to connect a Gunn oscillator therein to a stripline.

DETAILED DESCRIPTION OF AN EXAMPLE EMBODIMENT OF THE PRESENT INVENTION

In the following, like references numerals refer to like parts.

Figure 1A:
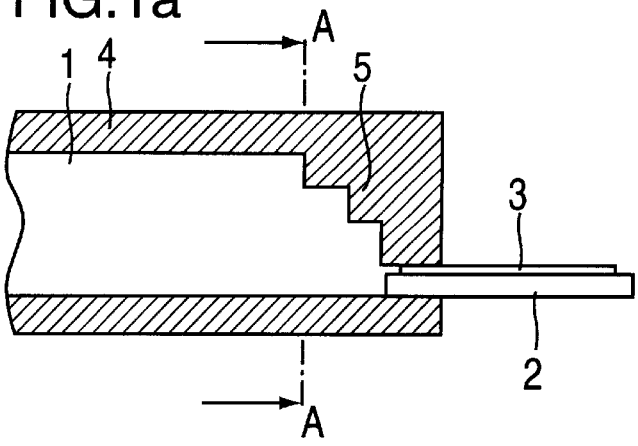
FIG. 1*a* shows a longitudinal section through a transition from a waveguide to a stripline with a stepped ridge.

In FIG. 1*a,* a cross section through a waveguide 1 is depicted, which transitions onto a stripline 3 supported by a substrate 2. For the transition from waveguide 1 to stripline 3, there is a ridge 5 on the wall of the waveguide 4 across from the stripline 3, the ridge running in the longitudinal direction of waveguide 1 and its height increasing in the direction of the stripline 3 in steps. This ridge 5, which forms a cross-section transformation, is bonded to stripline 3 at the point which forms the smallest waveguide cross section. Bonding can take place in various ways. For example, substrate 2 with stripline 3 can, as can be seen in FIG. 1*a,* be inserted into waveguide 1 below ridge 5 so that ridge 5 lies against stripline 3 and can be bonded to it through soldering or gluing. Ridge 5 can also be bonded via a conductive ribbon to stripline 3 which terminates in front of waveguide 1.

Figure 1B:
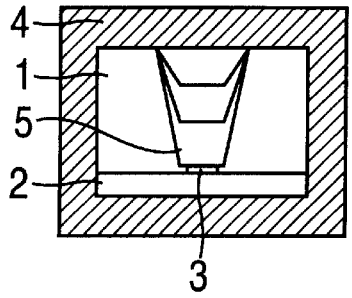
FIG. 1*b* shows a conical cross-section shape of an exemplary embodiment of the ridge according to the present invention.
Figure 1C:
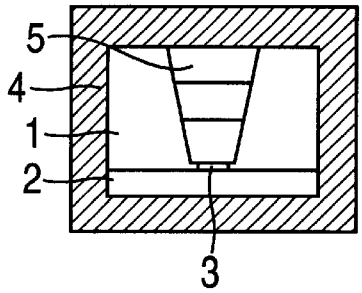
FIG. 1*c* shows a conical cross-section shape of another exemplary embodiment of the ridge according to the preset invention.

In FIG. 1*b,* a cross section A—A through waveguide 1 is presented. FIG. 1*b* shows that ridge 5 has a conically tapering cross section in the direction of stripline 3. In the case of ridge 5 depicted in FIG. 1*b*, each cross-section step is conically tapered from the same large starting cross section at the transition to waveguide wall 4 to the same small cross section facing stripline 3. FIG. 1*c* shows a somewhat different cross-section shape of ridge 5. Here all cross-section steps have two common conical edges.

Figure 2A:
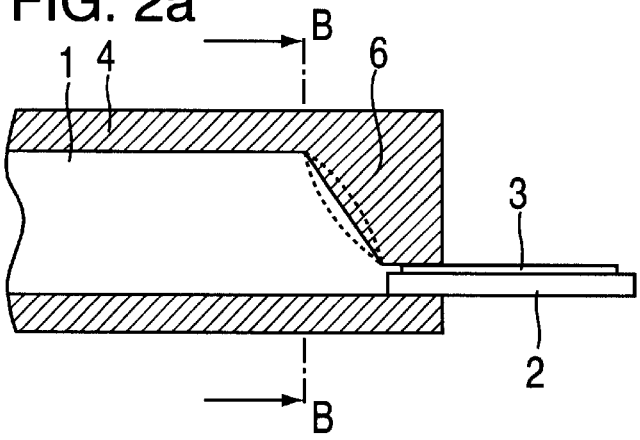
FIG. 2*a* shows a longitudinal section with a transition with continuous ridge throughout.
Figure 2B:
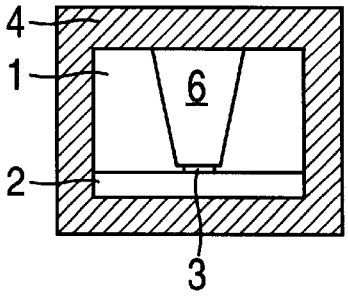
FIG. 2*b* shows a cross section through the transition according to FIG. 2*a*.

In the exemplary embodiment depicted in FIG. 2*a,* there is a ridge 6 in waveguide 1, the height of which increases continuously toward stripline 3. This continuous cross-section transition can have either a linear (solid line) or a non-linear course (dashed line). Cross section B—B presented in FIG. 2*b* again shows the conical cross-section shape of ridge 6.

Figure 3A:
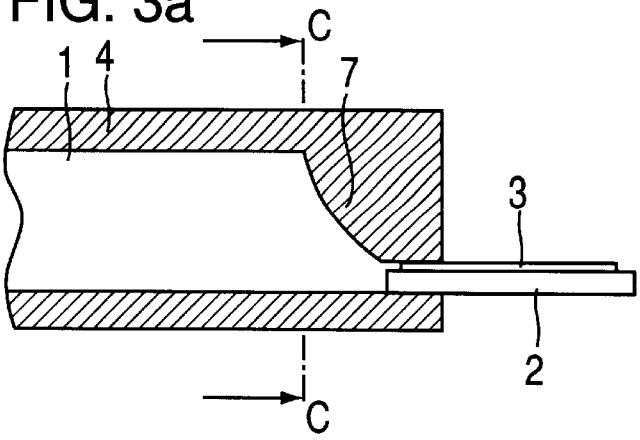
FIG. 3*a* shows a transition with a stepped continuous ridge.
Figure 3B:
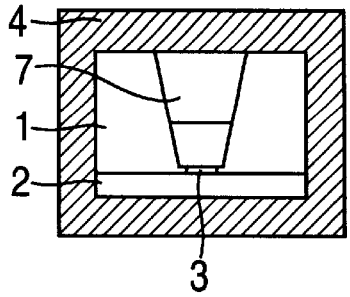
FIG. 3*b* shows cross section through the transition according to FIG. 3*a*.

The transition represented in FIG. 3*a* from waveguide 1 to stripline 3 has a ridge 7 with a cross-section transformation which is continuous in stages. Cross section C—C through waveguide 1 presented in FIG. 3*b* shows the conical cross-section shape of ridge 7.

Figure 4B:
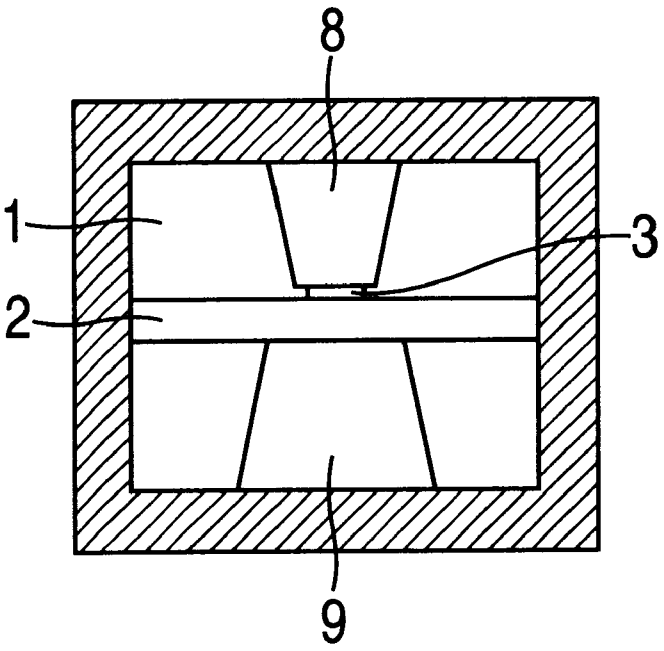
FIG. 4*b* shows a cross section through the transition according to FIG. 4*a*.
Figure 4A:
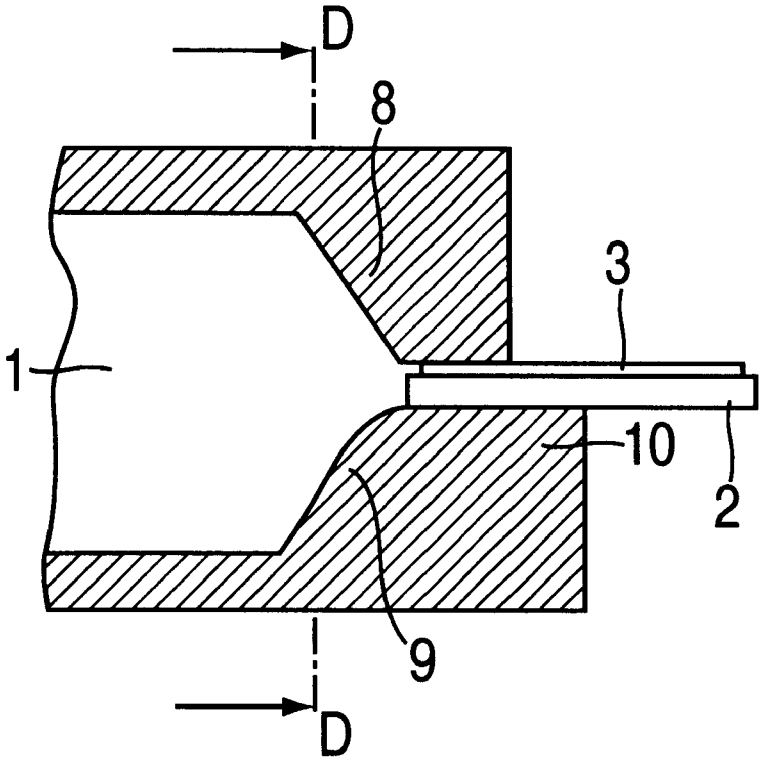
FIG. 4*a* shows a transition with two ridges.

Apart from the shapes of the ridge in the waveguide depicted in the drawing, any number of other shapes of ridge are possible for implementing optimal cross-section transformations. The cross-section transformation of the waveguide could also be implemented as two ridges 8 and 9 extending out from opposite sides of the waveguide 1 as can be seen in FIG. 4*a* in longitudinal section and in FIG. 4*b* in cross section D—D through waveguide 1.

Both ridges 8, 9 can have the cross-section shape depicted in FIGS. 1*a,* 1*b,* 1*c,* 2*a,* 2*b,* 3*a* and 3*b* or other cross-section shapes. In any event, both ridges 8, 9 are conically tapered toward stripline 3 (compare FIG. 4*b*). Substrate 2 with stripline 3 lies in a plane between the two ridges 8 and 9. It is advantageous for lower ridge 9 to continue in waveguide 1 toward the outside, as shown in FIG. 4*a,* so that a support 10 is formed for stripline substrate 2. Substrate 2 with stripline 3 can either be inserted between the two ridges 8, 9, as shown in FIG. 4*a,* or can terminate bluntly in front of waveguide 1.

Stamping, diecasting, and cold-molding processes and a plastic injection-molding process with subsequent metal plating are obvious examples of manufacturing processes suitable for mass production for the waveguide along with its ridge or ridges. As described at the beginning, the conical cross-section shape of the ridge or ridges offers special advantages. With these methods, the waveguide can be manufactured either together with the ridge or ridges as a one-piece unit or it can also advantageous to assemble the waveguide from two parts, each of which can be provided with a ridge. Each ridge can, of course, be produced as a separate part and afterwards mounted in the waveguide and fastened therein. The conical cross-section shape of the ridge provides a wide contact surface for attachment to a waveguide wall. This has an advantageous effect for attaching the ridge, for example via gluing or soldering or using screws.

What is claimed is:

1. A transition arrangement for providing a transition zone between a waveguide and a stripline, comprising:

at least one ridge situated in the waveguide, the at least one ridge extending from a respective wall of the waveguide which extends parallel to the stripline and is vertically separated from the stripline, the at least on ridge being bonded to the stripline, the at least one ridge having a height that increases in steps in a longitudinal axis of the waveguide in a direction of the stripline, a shape of a cross-section of the at least one ridge being tapered perpendicularly to the longitudinal axis, extending from the respective wall in the direction of the stripline, all of the steps of the at least one ridge being tapered in the cross-section facing the stripline, wherein a portion of the at least one ridge connected to the stripline has the narrowest cross-section of the at least one ridge;

wherein all of the steps of the at least one ridge are tapered to a same cross-sectional width facing the stripline.

2. The transition arrangement according to claim 1, wherein the at least one ridge includes a first ridge and a second ridge, the first ridge being situated on a first wall of the waveguide which is above the stripline, the second ridge being situated on a second wall of the waveguide which is below the stripline.

3. The transition arrangement according to claim 1 wherein the stripline protrudes into the waveguide.

4. The transition arrangement according to claim 1, wherein the stripline is positioned at one end of the waveguide.

5. A transition arrangement for providing a transition zone between a waveguide and a stripline, comprising;

at least one ridge situated in the waveguide, the at least one ridge extending from a respective wall of the waveguide which extends parallel to the stripline and is vertically separated from the stripline, the at least one ridge being bonded to the stripline, the at least one ridge having a height that increases in steps in a longitudinal axis of the waveguide in a direction of the stripline, a shape of a cross-section of the at least one ridge being tapered perpendicularly to the longitudinal axis, extending from the respective wall in the direction of the stripline, all of the steps of the at least one ridge being tapered in the cross-section facing the stripline, wherein a portion of the at least one ridge connected to the stripline has the narrowest cross-section of the at least one ridge.

6. The transition arrangement according to claim 5, wherein the stripline protrudes into the waveguide.

7. The transition arrangement according to claim 5, wherein the stripline is positioned at at one end of the waveguide.

8. The transition arrangement according to claim 5, wherein the at least one ridge includes a first ridge and a second ridge, the first ridge being situated on a first wall of the waveguide which is above the stripline, the second ridge being situated on a second wall of the waveguide which is below the stripline.

* * * * *